US009558874B2

(12) United States Patent
Sagawa

(10) Patent No.: US 9,558,874 B2
(45) Date of Patent: Jan. 31, 2017

(54) SINTERED NDFEB MAGNET AND METHOD FOR MANUFACTURING THE SAME

(75) Inventor: Masato Sagawa, Kyoto (JP)

(73) Assignee: INTERMETALLICS CO., LTD., Kyoto (JP)

( * ) Notice: Subject to any disclaimer, the term of this patent is extended or adjusted under 35 U.S.C. 154(b) by 591 days.

(21) Appl. No.: 13/383,034

(22) PCT Filed: Jul. 9, 2010

(86) PCT No.: PCT/JP2010/061712
§ 371 (c)(1),
(2), (4) Date: Mar. 23, 2012

(87) PCT Pub. No.: WO2011/004894
PCT Pub. Date: Jan. 13, 2011

(65) Prior Publication Data

US 2012/0176211 A1 Jul. 12, 2012

(30) Foreign Application Priority Data

Jul. 10, 2009 (JP) ..... 2009-164276

(51) Int. Cl.
*H01F 1/057* (2006.01)
*B22F 3/10* (2006.01)
(Continued)

(52) U.S. Cl.
CPC ..... *H01F 7/02* (2013.01); *B22F 1/025* (2013.01); *C22C 38/001* (2013.01);
(Continued)

(58) Field of Classification Search
USPC ..... 148/302
See application file for complete search history.

(56) References Cited

U.S. PATENT DOCUMENTS 7,594,972 B2 * 9/2009 Hasegawa et al. ..... 148/101
7,824,506 B2 11/2010 Machida et al.
(Continued)

FOREIGN PATENT DOCUMENTS

CN 1265947 A 9/2000
CN 1688000 A 10/2005
(Continued)

OTHER PUBLICATIONS

Jan. 27, 2014 First Office Action issued in Chinese Application No. 201080030500.X with English-language translation.
(Continued)

*Primary Examiner* — Jie Yang
*Assistant Examiner* — Xiaowei Su
(74) *Attorney, Agent, or Firm* — Oliff PLC

(57) ABSTRACT

Disclosed is a sintered NdFeB magnet having high coercivity ($H_{cJ}$) a high maximum energy product ($(BH)_{max}$) and a high squareness ratio (SQ) even when the sintered magnet has a thickness of 5 mm or more. The sintered NdFeB magnet is produced by diffusing Dy and/or Tb in grain boundaries in a base material of the sintered NdFeB magnet by a grain boundary diffusion process. The sintered NdFeB magnet is characterized in that the amount of rare earth in a metallic state in the base material is between 12.7 and 16.0% in atomic ratio, a rare earth-rich phase continues from the surface of the base material to a depth of 2.5 mm from the surface at the grain boundaries of the base material, and the grain boundaries in which $R_H$ has been diffused by the grain boundary diffusion process reach a depth of 2.5 mm from the surface.

3 Claims, 2 Drawing Sheets

(51) Int. Cl.

| | |
|---|---|
| ***B22F 1/00*** | (2006.01) |
| ***H01F 7/02*** | (2006.01) |
| ***C22C 38/00*** | (2006.01) |
| ***C22C 38/06*** | (2006.01) |
| ***C22C 38/10*** | (2006.01) |
| ***C22C 38/16*** | (2006.01) |
| ***B22F 1/02*** | (2006.01) |
| ***H01F 41/02*** | (2006.01) |

(52) U.S. Cl.

CPC ..... *C22C 38/002* (2013.01); *C22C 38/005* (2013.01); *C22C 38/06* (2013.01); *C22C 38/10* (2013.01); *C22C 38/16* (2013.01); *H01F 1/0571* (2013.01); *H01F 41/0293* (2013.01); *H01F 1/0577* (2013.01)

(56) References Cited

U.S. PATENT DOCUMENTS

| | | | |
|---|---|---|---|
| 2006/0213583 | A1 | 9/2006 | Nakamura et al. |
| 2006/0278517 | A1 | 12/2006 | Machida et al. |
| 2007/0240789 | A1 | 10/2007 | Nakamura et al. |
| 2008/0006345 | A1 | 1/2008 | Machida et al. |
| 2008/0223489 | A1 | 9/2008 | Nagata et al. |
| 2010/0119703 | A1 | 5/2010 | Sagawa |
| 2010/0129538 | A1 | 5/2010 | Kunieda et al. |
| 2010/0164663 | A1 | 7/2010 | Nagata et al. |
| 2010/0282371 | A1 | 11/2010 | Sagawa et al. |
| 2012/0176211 | A1 | 7/2012 | Sagawa |
| 2013/0169394 | A1 | 7/2013 | Sagawa et al. |

FOREIGN PATENT DOCUMENTS

| | | | |
|---|---|---|---|
| CN | 1802221 | A | 7/2006 |
| CN | 1812008 | A | 8/2006 |
| CN | 1938792 | A | 3/2007 |
| CN | 101006534 | A | 7/2007 |
| CN | 101076870 | A | 11/2007 |
| CN | 101911227 | A | 12/2010 |
| EP | 1643513 | A1 | 4/2006 |
| EP | 1 705 668 | A2 | 9/2006 |
| EP | 1 843 360 | A1 | 10/2007 |
| EP | 1 981 043 | A1 | 10/2008 |
| EP | 2 144 257 | A1 | 1/2010 |
| JP | A-62-74048 | | 4/1987 |
| JP | S62-192566 | A | 8/1987 |
| JP | A-1-117303 | | 5/1989 |
| JP | A-2004-359873 | | 12/2004 |
| JP | A-2005-320628 | | 11/2005 |
| JP | A-2006-303435 | | 11/2006 |
| JP | A-2007-53351 | | 3/2007 |
| JP | A-2007-258455 | | 10/2007 |
| JP | A-2007-287874 | | 11/2007 |
| JP | A-2007-287875 | | 11/2007 |
| JP | A-2007-329250 | | 12/2007 |
| JP | 2008-147634 | A | 6/2008 |
| WO | WO 2006/043348 | | 4/2006 |
| WO | WO 2006/064848 | A1 | 6/2006 |
| WO | 2007/088718 | A1 | 8/2007 |
| WO | WO 2008/032426 | A1 | 3/2008 |
| WO | WO 2008/139690 | A1 | 11/2008 |

OTHER PUBLICATIONS

Mar. 25, 2014 Notification of Reasons for Rejection issued in Japanese Application No. 2011-521979 with English-language translation.

Jun. 18, 2013 Office Action issued in U.S. Appl. No. 13/778,324.

Park, K.T., "Effect of Metal-Coating and Consecutive Heat Treatment on Coercivity of Thin Nd—Fe—B Sintered Magnets," *Proceedings of the Sixteenth International Workshop on Rare-Earth Magnets and Their Applications*, 2000, pp. 257-264, published by The Japan Institute of Metals, Japan.

Ishigaki, N. et al., "Surface Improvements on Magnetic Properties for Small-Sized Nd—Fe—B Sintered Magnets," *NEOMAX Technical Report*, 2005, pp. 15-19, vol. 15, published by Kabushiki Kaisha NEOMAX, Japan.

Machida, K. et al., "Grain Boundary Modification and Magnetic Characteristics of Nd—Fe—B Sintered Magnet," *Abstracts of Spring Meeting of Japan Society of Powder and Powder Metallurgy*, 2004, p. 1-47A, published by the Japan Society of Powder and Powder Metallurgy, Japan.

Hirota, K. et al., "Enhancement of Nd—Fe—B Sintered Magnet by Grain Boundary Diffusion," *Abstracts of Autumn Meeting of Japan Society of Powder and Powder Metallurgy*, 2005, p. 2-32A, published by the Japan Society of Powder and Powder Metallurgy, Japan.

Machida, K. et al., "Magnetic Characteristics of Nd—Fe—B Sintered Magnet with Modified Grain Boundary," *Abstracts of Autumn Meeting of Japan Society of Powder and Powder Metallurgy*, 2005, p. 2-33A, published by the Japan Society of Powder and Powder Metallurgy, Japan.

International Search Report and Written Opinion issued in International Application No. PCT/JP2009/000068 mailed on Apr. 14, 2009.

International Preliminary Report on Patentability issued in International Application No. PCT/JP2009/000068 on Aug. 10, 2010.

Chinese Office Action dated Jan. 4, 2012 issued in Chinese Patent Application No. 200980101615.0 (with English-language translation).

Aug. 31, 2012 Chinese Office Action issued in Chinese Patent Application No. 200980101615.0 (with English-language translation).

Sep. 18, 2012 Japanese Office Action issued in Japanese Patent Application No. 2008-004845 (with English-language translation).

Mar. 1, 2013 Chinese Office Action issued in Chinese Application No. 200980101615.0 (with English-language Translation).

Apr. 23, 2013 Notification of Reasons for Rejection issued in Japanese Application No. 2008-004845 with English-language translation.

Jul. 26, 2013 Chinese Office Action issued in Chinese Application No. 200980101615.0 with partial English-language translation.

Sep. 3, 2013 Notification of Reason for Rejection issued in Japanese Application No. 2011-521979 with English-language translation.

Imanari et al, "Study of Microstructure of Dy-Modified Neodymium Magnet," *Collected Abstracts of the 2009 Spring Meeting of the Japan Institute of Metals*, 2009, pp. 115 (with translation).

International Preliminary Report on Patentability dated Sep. 28, 2010 issued in International Patent Application No. PCT/JP2010/061712 (with translation).

International Search Report dated Sep. 28, 2010 issued in International Patent Application No. PCT/JP2010/061712 (with translation).

Dec. 3, 2013 Office Action issued in U.S. Appl. No. 13/778,324.

Jul. 7, 2014 Extended European Search Report issued in European Patent Application No. 10797205.1.

Sep. 16, 2014 Office Action issued in U.S. Appl. No. 13/778,324.

Sep. 19, 2014 Office Action issued in Chinese Application No. 201080030500.X (with English translation).

Sep. 11, 2015 Office Action issued in Chinese Application No. 201310261730.2.

Feb. 11, 2015 Office Action issued in U.S. Appl. No. 13/778,324.

Jul. 10, 2015 Extended European Search Report issued in European Application No. 09700197.8.

Jul. 28, 2015 Office Action issued in Chinese Application No. 201310571585.8.

Mar. 31, 2015 Office Action issued in Chinese Application No. 201310261730.2.

Apr. 3, 2015 Office Action issued in Chinese Application No. 201080030500.X.

Sep. 29, 2015 Office Action issued in Chinese Application No. 201080030500.X.

Mar. 11, 2016 Office Action issued in Chinese Application No. 201310571585.8.

Mar. 15, 2016 Office Action issued in Japanese Application No. 2015-010195.

(56) References Cited

OTHER PUBLICATIONS

Apr. 18, 2016 Office Action issued in Chinese Application No. 201310261730.2.
May 11, 2016 Office Action issued in European Application No. 09700197.8.
Sep. 28, 2016 Office Action issued in Chinese Patent Application 201310571585.8.
Oct. 31, 2016 Office Action issued in Chinese Patent Application No. 201310261730.2.

* cited by examiner (Dy AT 3 mm FROM THE SURFACE)

SINTERED NDFEB MAGNET AND METHOD FOR MANUFACTURING THE SAME

TECHNICAL FIELD

The present invention relates to a sintered NdFeB magnet having excellent characteristics of a high coercive force and a maximum energy product. It also relates to the method for manufacturing the sintered NdFeB magnet.

BACKGROUND ART

A sintered NdFeB magnet was discovered in 1982 by Sagawa, the inventor of this invention, and other researchers. Sintered NdFeB magnets exhibit characteristics far better than those of conventional permanent magnets, and can be advantageously manufactured from neodymium (a kind of rare earth element), iron, and boron, which are relatively abundant and inexpensive as raw materials. Hence, sintered NdFeB magnets are used in a variety of products such as a voice coil motor used for a hard disk drive or other apparatus, a driving motor of a hybrid or electric car, a motor for a battery-assisted bicycle, an industrial motor, a generator used for wind power generation or other power generation, high-grade speakers and headphones, and a permanent magnetic resonance imaging system. Sintered NdFeB magnets used for those purposes require a high coercive force $H_{cJ}$, a high maximum energy product $(BH)_{max}$, and a high squareness ratio SQ. The squareness ratio SQ is defined as $H_k/H_{cJ}$, where $H_k$ is the absolute value of the magnetic field measured when the magnetization intensity is decreased by 10% from the maximum on the magnetization curve.

One known method for enhancing the coercive force of a sintered NdFeB magnet is a single alloy method, in which a portion of Nd atoms in a starting alloy is substituted with Dy and/or Tb (hereinafter, "Dy and/or Tb" will be referred to as "$R_H$"). Another known method is a "binary alloy blending technique" in which a main phase alloy and a grain boundary phase alloy are independently prepared, and $R_H$ is densely added into the grain boundary phase alloy to increase the density of $R_H$ at the grain boundaries among the crystal grains in a sintered compact and the area around the grain boundaries. Further, a "grain boundary diffusion method" is also known in which a sintered body of a NdFeB magnet is prepared and then $R_H$ is diffused from the surface of the sintered body to the inside thereof through the grain boundaries so that the concentration of $R_H$ will increase only in the area near the grain boundaries of the sintered compact (Patent Document 1).

BACKGROUND ART DOCUMENT

Patent Document

[Patent Document 1] WO-A1 2006/043348
[Patent Document 1] JP-A 2005-320628

DISCLOSURE OF THE INVENTION

Problem To Be Solved By the Invention

In the single alloy method, the existence of $R_H$ in the grains of the sintered compact increases the coercive force but disadvantageously decreases the maximum energy product $(BH)_{max}$. In addition, more $R_H$ is consumed than in the grain boundary diffusion method or in the binary alloy blending technique. With the binary alloy blending technique, the use of $R_H$ can be suppressed to be less than in the single alloy method. However, the heat generated in the sintering process makes $R_H$ diffuse not only in the grain boundaries but also to a considerable extent into the grains, which disadvantageously decreases the maximum energy product $(BH)_{max}$ as in the single alloy method.

On the other hand, in the grain boundary diffusion method, $R_H$ is diffused into the grain boundaries at temperatures lower than the sintering temperature. Hence, $R_H$ is diffused only near the grain boundaries. Consequently, it is possible to obtain a sintered NdFeB magnet having a coercive force as high as that in the single alloy method while suppressing the decrease of the maximum energy product $(BH)_{max}$. In addition, the used amount of $R_H$ is smaller than in the single alloy method. However, in the conventional grain boundary diffusion method, the depth of the grain boundaries into which $R_H$ can be diffused is only less than 1.5 mm from the surface of the sintered compact. In recent years, a sintered NdFeB magnet of equal to or more than 5 mm in thickness is used in a large motor for a hybrid car or in a large generator for a wind power generator. In such a thick magnet, $R_H$ cannot be spread throughout the entire grain boundaries. Hence, the coercive force $H_{cJ}$ and the squareness ratio SQ cannot be sufficiently increased.

As just described, no conventional sintered NdFeB magnet of equal to or more than 5 mm in thickness has high values in all the three characteristics of the coercive force $H_{cJ}$, the maximum energy product $(BH)_{max}$, and the squareness ratio SQ. In particular, there is a trade-off between the coercive force $H_{cJ}$ and the maximum energy product $(BH)_{max}$, which can be confirmed by the fact that a graph in which the coercive force $H_{cJ}$ is assigned to the horizontal axis and the maximum energy product $(BH)_{max}$ to the vertical axis can be adequately approximated by a linear function with a negative slope.

The problem to be solved by the present invention is to provide a sintered NdFeB magnet having a high coercive force $H_{cJ}$, as well as having high values of maximum energy product $(BH)_{max}$ and the squareness ratio SQ, even in the case where the magnet is equal to or more than 5 mm in thickness. The present invention also provides a method for manufacturing such a sintered NdFeB magnet.

Means For Solving the Problem

To solve the aforementioned problems, the present invention provides a sintered NdFeB magnet in which Dy and/or Tb ($R_H$) are diffused in grain boundaries of a base material of the sintered NdFeB magnet by a grain boundary diffusion process, wherein:

- an amount of rare earth in a metallic state in the base material is between 12.7% and 16.0% in atomic ratio;
- at the grain boundaries of the base material, a rare-earth rich phase continues from a surface of the base material to a depth of 2.5 mm from the surface; and
- the grain boundaries into which $R_H$ has been diffused by the grain boundary diffusion process reach a depth of 2.5 mm from the surface.

The inventor of the present invention has discovered that a sufficient amount of rare earth in a metallic state must exist in grain boundaries in order that the grain boundary diffusion method for a sintered NdFeB magnet can work effectively. If a sufficient amount of rare earth in a metallic state exists in the grain boundaries, the melting point of the grain boundaries becomes lower than that of the crystal grains, and therefore the grain boundaries melt in the grain boundary diffusion process. The melted grain boundaries serve as a passage for $R_H$, allowing the $R_H$ to be diffused to a depth of 2.5 mm (or even deeper) from the surface of the sintered NdFeB magnet. Additionally, the inventor of the present invention has discovered that, in order that a sufficient amount of rare earth in a metallic state exists in the grain boundaries, the amount of rare earth in a metallic state in the sintered NdFeB magnet base material before the grain boundary diffusion process is performed has to be equal to or higher than 12.7 atomic percent, which is approximately 1 atomic percent higher than 11.76 atomic percent of the amount of rare earth in the sintered NdFeB magnet that is expressed by the composition formula of $Nd_2Fe_{14}B$.

However, if the amount of are earth in a metallic state in the base material exceeds 16.0 atomic percent, the volume ratio of the main phase grains having a composition of $Nd_2Fe_{14}B$ decreases, and therefore, a high $(BH)_{max}$ cannot be obtained. Given this factor, in the present invention, the upper limit of this amount of rare earth is set at 16.0 atomic percent.

Even if the amount of rare earth in a metallic state in the base material is equal to or higher than 12.7 atomic percent, if the rare-earth rich phase (i.e. the phase having a higher level of rare-earth content than the average of the entire base material) is not continuous between the surface of the base material and the depth of 2.5 mm from the surface, the passage of $R_H$ formed by the melted grain boundaries becomes discontinuous during the grain boundary diffusion process. Consequently, the $R_H$ cannot reach the depth of 2.5 mm or more from the surface of the base material. Accordingly, in the present invention, at the grain boundaries of the base material, the rare-earth rich phase must be continuous between the surface of the base material and the depth of 2.5 mm from the surface.

A base material having grain boundaries in which rare-earth rich phase is continuous as previously described can be made by sintering a fine powder in which powder of rare-earth rich phase is attached to main phase grains of a NdFeB magnet. Attaching the rare-earth rich phase to the main phase has the effect of evenly distributing the grain boundaries of the rare-earth rich phase throughout the sintered body. As a consequence, the rare-earth rich phase of the grain boundaries becomes continuous without interruption from the surface of the base material to a depth of at least 2.5 mm.

Such a powder can be prepared in the following manner for example. First, as shown in FIG. 1A, a lamella-structured starting alloy ingot 10 in which rare-earth rich phases 12 having a plate shape (which is called a "lamella") are distributed in a main phase 11 at an average interval L which is approximately the same as the target average grain size $R_a$ of the powder to be prepared. Then, the starting alloy is ground so that the average grain size becomes $R_a$ (FIG. 1B). The powder obtained by this method has fragments 14 of the rare-earth rich phase lamella attached to the surface of most of the grains 13.

As described in Patent Document 2 for example, a NdFeB magnet alloy plate having a lamella structure in which rare-earth rich phase lamellas are distributed almost evenly at predetermined intervals can be obtained by a strip cast method. The intervals between the rare-earth rich phase lamellas in this lamella structure can be controlled by adjusting the rotational speed of a cooling roller used in the strip cast method. The average diameter of the fine powder can be controlled by combining a hydrogen pulverization method and a jet-milling method in the following manner. Initially, a starting alloy is subjected to an embrittlement process by the hydrogen pulverization method. Although this embrittles the entire starting alloy, the rare-earth rich phase lamellas become more brittle than the main phase. Therefore, when a crushing process is subsequently performed by the jet-milling method, the alloy plate is pulverized at the position of the rare-earth rich phase lamellas. As a consequence, a fine powder with an average grain size of $R_a$ can be obtained, and fragments of the rare-earth rich phase lamellas which have been positioned at the pulverized borders attach to the surface of the fine powder grains. However, if too much energy is given to the alloy in the crushing process by the jet-milling method, the powder of the rare-earth rich phase comes off the crystal grains. In that case, in order to obtain desirable fine powder grains as shown in FIG. 1B, the pressure of the used gas may be decreased or the amount of alloy accumulated in the apparatus during the process may be decreased.

As previously described, in the sintered NdFeB magnet according to the present invention, $R_H$ is diffused to a depth of 2.5 mm or even deeper from the surface. Therefore, a high coercive force $H_{cJ}$ can be obtained. In addition, since the grain boundary diffusion method is used, it is possible to suppress a decrease of the maximum energy product $(BH)_{max}$, which is a problem in the single alloy method or in the binary alloy blending technique.

The "amount of rare earth in a metallic state" in the present invention is defined as the amount obtained by subtracting the amount of rare earth which has changed to the oxide, carbide, or nitride of the rare earth, or the complex compound thereof as a result of oxidization, carbonization, or nitridation from the entire amount of rare earth contained in the sintered NdFeB magnet of the base material.

The "amount of rare earth in a metallic state" can be obtained by analyzing the sintered NdFeB magnet of the base material as follows. The amount of all the rare earth atoms, oxygen atoms, carbon atoms, and nitrogen atoms contained in the sintered NdFeB magnet can be measured by a general chemical analysis. On the assumption that these oxygen atoms, carbon atoms, and nitrogen atoms respectively form $R_2O_3$, RC, and RN (where R is a rare earth), the amount of rare earth in a metallic state can be obtained by subtracting the amount of rare earth which has been non-metalized by oxygen, carbon, and nitrogen from the amount of all the rare earth. However, it is actually possible that not only simple compounds such as $R_2O_3$, RC, and RN, but also compounds having a different atomic ratio and complex compounds may be created. Using the amount of rare earth in the base material obtained in the aforementioned manner, the inventor of the present invention has experimentally confirmed that, when that amount is equal to or higher than 12.7 atomic percent, a sintered compact having a large pole area and a relatively large thickness of equal to or more than 5 mm, and yet exhibiting a desired high coercive force, can be produced by the grain boundary diffusion process using $R_H$ even if a base material that does not contain $R_H$ is used.

In order to send the $R_H$ to the depth of 2.5 mm or even deeper from the surface of the sintered compact, in manufacturing the sintered NdFeB magnet according to the present invention, 10 mg or more per 1 $cm^2$ of $R_H$ may be diffused from the surface of the base material. If this amount of diffusion is less than 10 mg, the $R_H$ might become in short supply before the $R_H$ reaches the depth of 2.5 mm from the base material surface. Methods for supplying the $R_H$ from the surface of the base material include: forming a coat containing $R_H$ on the base material surface by sputtering or application of fine particles and then heating the base material; or exposing the base material surface to sublimated $R_H$. Of these methods, the optimum method is applying fine particles of metal or alloy containing $R_H$ in the light of productivity and processing cost. Particularly preferable examples of the fine particles to be applied are: a powder of an alloy of iron group transition metal with an $R_H$ content of equal to or higher than 50 atomic percent; a pure-metallic powder composed of only $R_H$; a powder of the hydride of the alloy or pure metal; a mixed powder of $R_H$ fluoride powder and Al powder.

Effect of the Invention

In the sintered NdFeB magnet according to the present invention, the grain boundaries in which $R_H$ exists reach as deep as 2.5 mm from the surface. Consequently, even if the thickness is equal to or more than 5 mm, the sintered NdFeB magnet has a high coercive force $H_{cJ}$ as well as high values of maximum energy product $(BH)_{max}$ and squareness ratio SQ.

BEST MODE FOR CARRYING OUT THE INVENTION

Figure 1A:
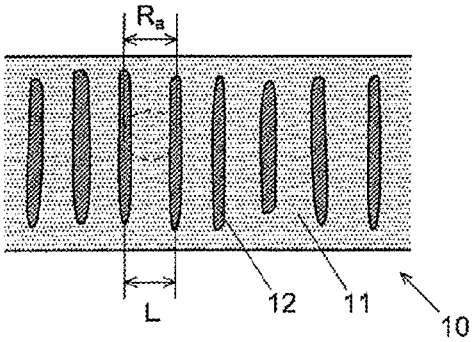
FIG. 1A is a schematic diagram showing a starting alloy ingot having lamellas of rare-earth rich phase.
Figure 1B:
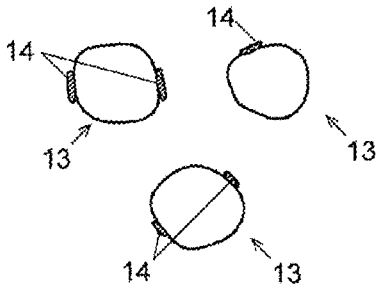
FIG. 1B is a schematic diagram showing a fine powder obtained by crushing the starting alloy ingot.

Hereinafter, an embodiment of an sintered NdFeB magnet according to the present invention and a method for manufacturing it will be described.

Embodiment

A method for manufacturing a sintered NdFeB magnet of the present invention and that of a comparative example will be described.

Initially, an alloy of a NdFeB magnet was made by using a strip cast method. Subsequently, the alloy was roughly crushed by a hydrogen pulverization method, a lubricant was added to the obtained coarse grains, and then the coarse grains were ground into fine powder in a nitrogen gas stream by a 100AFG jet-milling apparatus, produced by Hosokawa Micron Corporation, to obtain a powder of NdFeB magnet. During the process, the grain size of the fine powder created by the grinding process was controlled so that the median ($D_{50}$) of the grain size distribution measured by a laser diffraction method would be 5 gm. Next, a lubricant was added to this powder, and the powder was filled into a filling container to a density of 3.5 through 3.6 g/cm$^3$. After being oriented in a magnetic field, the powder was heated at 1000° through 1020° C. in a vacuum to be sintered. Then, after being heated at 800° C. in an inactive gas atmosphere for one hour, the sintered compact was rapidly cooled. Further, the sintered compact was heated at 500 through 550° C. for two hours and was rapidly cooled. As a result, a compact (which will hereinafter be called a "base material") of a sintered NdFeB magnet before the diffusion of $R_H$ was obtained.

The aforementioned operation was performed for 12 kinds of alloys having different compositions. The compositions of the obtained 12 kinds of base materials (S-1 through S-9, and C-1 through C-3) are shown in Table 1, and their magnetic properties are shown in Table 2. In Table 2, "$B_r$" is a residual flux density, and "MN" is an abbreviation of "Magic Number", which is a value defined as the sum of a value of $H_{cJ}$ expressed in kOe and that of $(BH)_{max}$ expressed in MGOe. Conventionally, in the sintered NdFeB magnets manufactured under the same conditions, the values of "MN" are almost constant because, as previously explained, the relationship between $H_{cJ}$ and $(BH)_{max}$ can be approximated by a linear function having a negative slope. The value of MN of the sintered NdFeB magnets manufactured by a conventional common method is around 59 through 64, and does not exceed 65. Also for the base materials shown in Table 2, MN is within that range.

TABLE 1

| BASE MATERIAL | NONMETAL ATOM (ppm) | | | METAL ATOM (Percent by Weight) | | | | | | | | |
|---|---|---|---|---|---|---|---|---|---|---|---|---|
| NUMBER | O | C | N | Nd | Dy | Pr | Co | Cu | B | Al | Fe | MR |
| S-1 | 1100 | 685 | 290 | 26.60 | 0.03 | 4.70 | 0.92 | 0.09 | 1.01 | 0.27 | Bal. | 13.40 |
| S-2 | 1420 | 830 | 370 | 26.40 | 0.00 | 4.60 | 0.90 | 0.09 | 1.00 | 0.27 | Bal. | 13.01 |
| S-3 | 1920 | 950 | 380 | 26.50 | 0.00 | 4.50 | 0.91 | 0.09 | 1.00 | 0.26 | Bal. | 12.79 |
| S-4 | 1130 | 810 | 380 | 26.70 | 0.01 | 4.70 | 0.92 | 0.09 | 1.04 | 0.26 | Bal. | 13.30 |
| S-5 | 900 | 770 | 310 | 26.60 | 0.00 | 4.70 | 0.92 | 0.09 | 1.03 | 0.26 | Bal. | 13.38 |
| S-6 | 1000 | 900 | 480 | 22.20 | 4.00 | 6.30 | 0.89 | 0.12 | 1.00 | 0.20 | Bal. | 13.71 |
| S-7 | 1820 | 1000 | 680 | 22.10 | 4.00 | 6.10 | 0.89 | 0.12 | 0.99 | 0.20 | Bal. | 13.12 |
| S-8 | 1790 | 950 | 740 | 22.00 | 4.20 | 6.20 | 0.90 | 0.09 | 1.01 | 0.20 | Bal. | 13.21 |
| S-9 | 1930 | 1220 | 760 | 22.00 | 4.10 | 6.00 | 0.91 | 0.10 | 1.01 | 0.20 | Bal. | 12.86 |
| C-1 | 1850 | 1240 | 880 | 26.55 | 0.01 | 4.70 | 0.90 | 0.09 | 1.00 | 0.27 | Bal. | 12.51 |
| C-2 | 1980 | 1100 | 850 | 30.30 | 0.11 | 0.28 | 0.94 | 0.08 | 0.98 | 0.22 | Bal. | 12.23 |
| C-3 | 1910 | 1340 | 1000 | 21.60 | 4.00 | 6.10 | 0.90 | 0.10 | 1.00 | 0.20 | Bal. | 12.45 |

TABLE 2

| BASE MATERIAL NUMBER | $B_r$ (kG) | $H_{cJ}$ (kOe) | $(BH)_{max}$ (MGOe) | $H_k$ (kOe) | SQ (%) | MN |
|---|---|---|---|---|---|---|
| S-1 | 13.8 | 15.7 | 46.7 | 14.4 | 91.8 | 62.4 |
| S-2 | 13.8 | 15.6 | 46.4 | 14.6 | 93.9 | 62.0 |
| S-3 | 13.8 | 15.5 | 46.5 | 14.5 | 93.3 | 62.0 |

TABLE 2-continued

| BASE MATERIAL NUMBER | $B_r$ (kG) | $H_{cJ}$ (kOe) | $(BH)_{max}$ (MGOe) | $H_k$ (kOe) | SQ (%) | MN |
|---|---|---|---|---|---|---|
| S-4 | 14.2 | 13.0 | 49.0 | 11.6 | 89.2 | 62.0 |
| S-5 | 14.2 | 13.5 | 49.3 | 12.1 | 89.6 | 62.8 |
| S-6 | 12.8 | 23.3 | 40.7 | 21.3 | 91.5 | 64.0 |
| S-7 | 13.0 | 22.7 | 41.2 | 20.7 | 91.2 | 63.9 |
| S-8 | 12.7 | 22.6 | 40.1 | 20.6 | 91.2 | 62.7 |
| S-9 | 12.8 | 22.4 | 40.7 | 20.4 | 91.1 | 63.1 |
| C-1 | 14.1 | 12.4 | 48.2 | 11.1 | 89.5 | 60.6 |
| C-2 | 14.2 | 10.2 | 49.0 | 8.9 | 87.3 | 59.2 |
| C-3 | 13.0 | 21.7 | 41.2 | 19.7 | 90.8 | 62.9 |

The values of the compositions shown in Table 1 were obtained by a chemical analysis of the base materials. The value of MR is the amount of rare earth in a metallic state expressed in atomic percent, and was calculated from the values obtained by the aforementioned chemical analysis. In other words, the value of MR was obtained by subtracting the amount of rare earth consumed (non-metalized) by oxygen, carbon, and nitrogen from the entire amount of rare earth of the analysis value. In this calculation, it was presumed that these impurity elements were respectively combined with rare earth R to form $R_2O_3$, RC, and RN.

The base materials C-1 through C-3 each have an MR value of less than 12.7%, which is out of the scope of the present invention (i.e. within that of a comparative example). On the other hand, the base materials S-1 through S-9 each have an MR value of equal to or more than 12.7%, which is within the scope of the present invention. Of these, the base materials S-1 through S-5 do not contain Dy in excess of the impurity level, whereas the base materials S-6 through S-9 contain around 4 atomic percent of Dy. The base materials S-1 through S-9 are grouped based on the following two terms. The first group is composed of the base materials S-1 through S-3, and S-6 and S-7. For these base materials, when an alloy was put into a jet mill, the initial input amount was approximately 400 g, the supply rate was approximately 30 g per minute, and the pressure of nitrogen gas was 0.6 MPa. The second group is composed of the base materials S-4, S-5, S-8, and S-9. For these base materials, the initial input amount was more than that of the first group. The initial input amount was approximately 700 g, the supply rate was approximately 40 g per minute, and the pressure of nitrogen gas was 0.6 MPa.

Next, for the twelve kinds of base materials S-1 through S-9, and C-1 through C-3, rectangular parallelepiped base materials of 7 mm in length by 7 mm in width by 5 mm or 6 mm in thickness were cut out in such a manner that the thickness direction coincided with the direction of the magnetic orientation.

Along with the manufacture of the rectangular parallelepiped base materials as previously described, a powder to be applied to the rectangular parallelepiped base materials was prepared in order to perform the grain boundary diffusion method. Table 3 shows the compositions of the powders used in the present embodiment. The average grain size of the powders A and B was 6 μm. The average grain size of the $DyF_3$ powder used for the powders C and D was approximately 3 μm, and the average grain size of the Al powder used for the powder C was approximately 5 μm.

TABLE 3

(Unit: Percent by Weight)

| POWDER SYMBOL | Dy | Ni | Co | $DyF_3$ | Al |
|---|---|---|---|---|---|
| A | 92 | 4.3 | 0 | 0 | 3.7 |
| B | 91.6 | 0 | 4.6 | 0 | 3.8 |
| C | 0 | 0 | 0 | 90 | 10 |
| D | 0 | 0 | 0 | 100 | 0 |

Subsequently, the powders A through D were applied to the surface of the rectangular parallelepiped base materials in the following manner. Initially, 100 $cm^3$ of zirconia spherules with a diameter of 1 mm was put into a plastic beaker with a capacity of 200 $cm^3$, 0.1 through 0.5 g of liquid paraffin was added thereto, and the spherules were stirred. A rectangular parallelepiped base material was put into the plastic beaker, and the base material and spherules in the beaker were vibrated by placing the beaker in contact with a vibrator, so that an adhesive layer composed of paraffin was formed on the surface of the rectangular parallelepiped base material. Then, 8 $cm^3$ of stainless spherules with a diameter of 1 mm were put into a glass bottle with a capacity of 10 $cm^3$, 1 through 5 g of the powder shown in Table 2 were added, and the rectangular parallelepiped base material coated with the adhesive layer was put into the glass bottle. For the reason which will be described later, the sides of the rectangular parallelepiped base material (i.e. the surfaces other than the pole faces) were masked with a plastic plate to prevent the powder from being applied to these sides of the magnet. This glass bottle was brought into contact with the vibrator to make a sintered NdFeB magnet in which a powder containing Dy was applied only to the pole faces. The amount of applied powder was adjusted by controlling the amount of the liquid paraffin and that of the powder added in the previously described step.

The reason why the powder was applied only to the pole faces is as follows. Aiming at an application to a relatively large motor, the present invention had to prove to be an effective technology for a magnet having a relatively large pole area. However, the use of a magnetization curve measuring device (for performing a measurement by applying a pulsed magnetic field) inevitably limited the pole area. For this reason, a sample having a relatively small pole area of 7 mm square was used. To overcome this limitation, the powder was not applied to the sides of the sample so as to create a situation virtually equivalent to the case where an experiment of the grain boundary diffusion method was performed for a sample having a large pole area.

Then, the rectangular parallelepiped base material coated with a powder was put on a molybdenum plate, with one of the sides to which the powder was not applied facing downward, and then heated in a vacuum of $10^{-4}$ Pa. The heating was performed at a temperature of 900° C. for three hours. After that, the base material was rapidly cooled down to the room temperature, heated at 500 through 550° C. for two hours, and rapidly cooled down again to the room temperature.

In the aforementioned manner, fifteen kinds of samples D-1 through D-15 were prepared. Table 4 shows: the base material of each sample; the combination of the powder and the application amount of the powder; the measurement values of coercive force $H_{cJ}$, maximum energy product $(BH)_{max}$, MN, and squareness ratio SQ; and the measurement result of the presence of Dy at the central position in the thickness direction (2.5 mm from the surface for a sample having a thickness of 5 mm, and 3 mm from the surface for a sample having a thickness of 6 mm).

TABLE 4

| SAMPLE NUMBER | BASE MATERIAL NUMBER | THICKNESS OF BASE MATERIAL | APPLIED POWDER | $H_{cJ}$ (kOe) | $(BH)_{max}$ (MGOe) | MN | SQ (%) | Dy DETECTION | WITHIN THE SCOPE OF THE PRESENT INVENTION? |
|---|---|---|---|---|---|---|---|---|---|
| D-1 | S-1 | 5 | A | 22.2 | 44.9 | 67.1 | 90.8 | Y | Y |
| D-2 | S-2 | 5 | A | 22.0 | 45.1 | 67.1 | 91.3 | Y | Y |
| D-3 | S-3 | 5 | A | 21.9 | 44.7 | 66.6 | 90.5 | Y | Y |
| D-4 | S-4 | 5 | A | 19.5 | 47.8 | 67.3 | 81.5 | N | N |
| D-5 | S-5 | 5 | A | 19.3 | 47.4 | 66.7 | 82.3 | N | N |
| D-6 | S-6 | 6 | A | 28.4 | 38.7 | 67.1 | 93.3 | Y | Y |
| D-7 | S-7 | 6 | A | 28.3 | 39.4 | 67.7 | 93.4 | Y | Y |
| D-8 | S-8 | 5 | A | 27.0 | 39.8 | 63.2 | 83.4 | N | N |
| D-9 | S-9 | 5 | A | 26.9 | 39.6 | 62.1 | 85.2 | N | N |
| D-10 | C-1 | 5 | A | 18.8 | 46.8 | 60.9 | 82.7 | N | N |
| D-11 | C-2 | 5 | A | 16.6 | 47.8 | 61.3 | 79.8 | N | N |
| D-12 | C-3 | 5 | A | 23.4 | 38.6 | 62.0 | 86.7 | N | N |
| D-13 | S-1 | 5 | B | 21.8 | 44.9 | 66.7 | 90.8 | Y | Y |
| D-14 | S-1 | 5 | C | 21.3 | 45.6 | 66.9 | 90.2 | Y | Y |
| D-15 | S-1 | 5 | D | 17.0 | 46.1 | 63.1 | 85.6 | N | N |

The magnetic properties were measured with a pulse magnetization measuring system (trade name: Pulse BH Curve Tracer PBH-1000), with the largest application magnetic field of 10T, produced by Nihon Denji Sokki Co., Ltd. Pulse magnetization measuring systems are suitable for evaluating high $H_{cj}$ magnets which are a subject matter of the present invention. However, as compared to a general system for measuring magnetization by applying a direct-current magnetic field (which is also called a direct-current B-H tracer), the pulse magnetization measuring equipment is known to tend to yield a lower squareness ratio SQ of the magnetization curve. A squareness ratio SQ equal to or higher than 90% in the present embodiment is comparable to a level equal to or higher than 95% measured by a direct-current magnetization measuring system.

Figure 2:
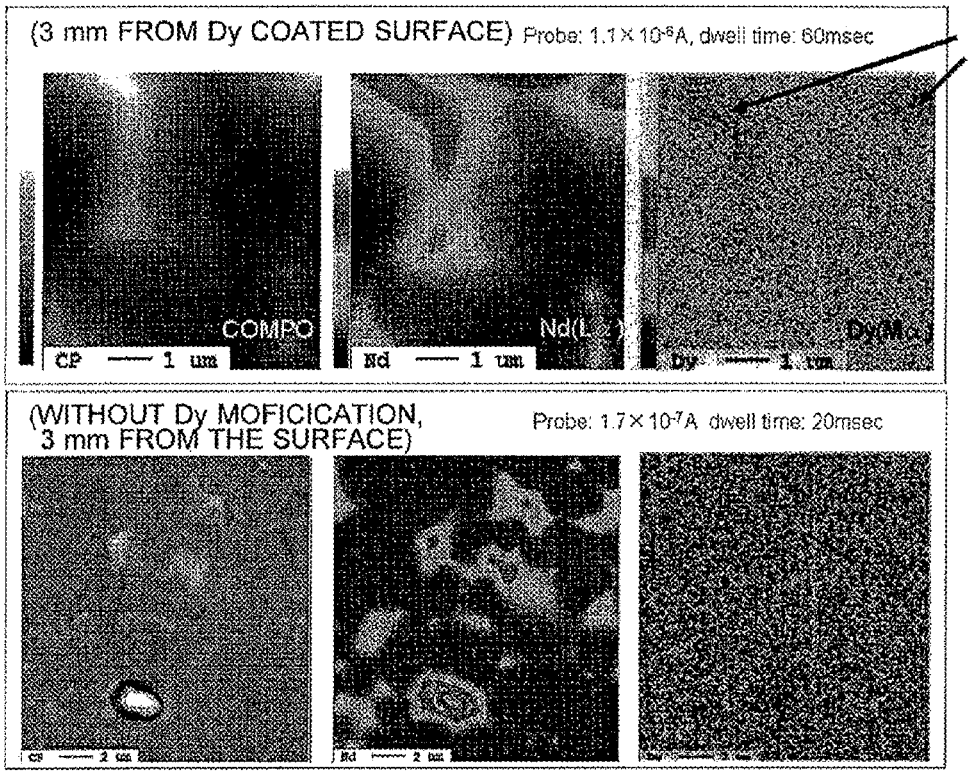
FIG. 2 is a wavelength dispersive spectrometry (WDS) map at a depth of 3 mm from the pole face, measured for the present embodiment and a comparative example.
Figure 3:
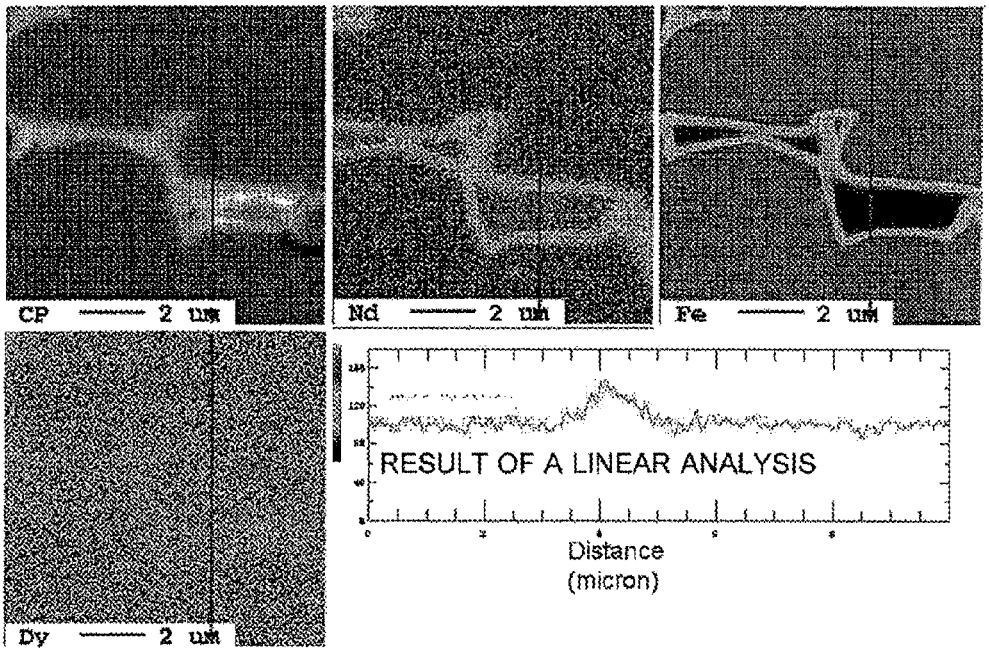
FIG. 3 shows the result of a linear analysis in which a concentration distribution of Dy was measured in one direction on a cutting surface of a sample that had undergone a grain boundary diffusion process.

The presence of Dy at the central position in the thickness direction was determined in the following manner. A section which passes through the central position and which is parallel to the pole faces of the sample was cut out by a peripheral cutter, the cut surface was polished, and then Dy was detected by the WDS analysis by an electron probe microanalyzer (EPMA; JXA-8500F produced by JOEL Ltd.). As an example, FIG. 2 (upper images) shows WDS map images at a depth of 3 mm from the pole face of a sample created from the base material S-1 by applying the powder A to only one of the pole faces and performing the aforementioned grain boundary diffusion process and the subsequent heat treatment. FIG. 2 also shows WDS map images (lower images) at a depth of 3 mm of another sample created from the base material S-1 without performing the grain boundary diffusion process. In these images, the white portions in the "COMPO" images indicate crystal grain boundaries of the rare-earth rich phase. Since the amount of Dy originally contained in the base material S-1 is no higher than impurity levels, no Dy was found at the grain boundaries in the sample for which the grain boundary diffusion process had not been performed. By contrast, Dy was detected (at the portions indicated with the arrows in the upper images) in the sample for which the grain boundary diffusion process had been performed. FIG. 3 shows the result of a linear analysis in which the concentration distribution of Dy in one direction on the cut surface was measured for the sample for which the grain boundary diffusion process had been performed. This linear analysis also confirmed that Dy was concentrated at the grain boundaries. The determination result of "Dy detection" shown in Table 4 was obtained by this WDS analysis.

The result shown in Table 4 demonstrates that only the sintered NdFeB magnets in which the value of MR in a metallic state contained in the base material of the sintered NdFeB magnet was equal to or higher than 12.7 atomic percent and the concentration of Dy in the crystal boundaries was detected at a depth of equal to or more than 2.5 mm from the surface of the sintered compact, have a high $H_{cJ}$, high $(BH)_{max}$, and a high SQ value. The samples D-4, D-5, D-8, and D-9, which were prepared by using the base materials S-4, S-5, S-8, and S-9 (which were the base materials of the second group) having a relatively high MR value, had no concentration of Dy at the grain boundaries at the central portion of the sample for the reason which will be described later. Such samples all do not have a high $H_{cJ}$, high $(BH)_{max}$, or high SQ value. Only the sintered NdFeB magnet of a sample which satisfies the following two conditions has an MN value exceeding 66 and an SQ value equal to or higher than 90: the MR value is equal to or higher than 12.7 atomic percent and the concentration of Dy at the crystal grain boundaries is detected at a depth of equal to or more than 2.5 mm from the surface of the sintered compact. Every sample was made by using the base materials of the first group.

The difference between the samples prepared from the base materials of the first group and the samples prepared from the base materials of the second group will be described. For the first group and the second group, an alloy powder before being formed into a base material (sintered compact) was observed with an electron microscope and the ratio of the grains with the rare-earth rich phases attached thereon to the whole grains was obtained. As a result, the ratio was equal to or higher than 80% for the first group, whereas the ratio was not higher than 70% for the second group. Such a difference probably occurred due to the difference of the conditions of the previously described process of preparing fine powders. It is known that, in the 100AFG jet milling apparatus, the crushing energy tends to be larger as the amount of crushing object accumulated in the apparatus becomes larger and as the gas pressure becomes higher. In a strip cast alloy before crushing, plate-like lamellas of rare-earth rich phase are distributed at regular intervals. Hence, the higher the crushing energy becomes (i.e. more for the second group than for the first group), the more easily the rare-earth rich phases are separated. If a rare-earth rich phase is separated from the main phase, a point where a rare-earth rich phase does not exist appears in the grain boundaries after the sintering, causing a discontinuity of the rare-earth rich phases. At such a chasm, when the base material is heated in the grain boundary diffusion process, the grain boundaries will not be melted. In the grain boundary diffusion process, $R_H$ diffuses within the base material (sintered compact) through melted grain boundaries as a passage, and therefore does not reach the portion deeper than the chasm of the rare-earth rich phases. Consequently, in the position deeper than equal to or more than 2.5 m a from the surface of the sintered compact, Dy does not exist for the second group, whereas Dy exists for the first group.

A sintered NdFeB magnet used for a high-tech product such as a large motor for a hybrid or electric car is required to have a large $H_{cJ}$ and $(BH)_{max}$, and therefore large MN, in addition to a large SQ value. Further, a magnet to be used in such large motors normally has a relatively large thickness of equal to or more than 5 mm. Conventionally, no magnet with such a thickness has the aforementioned characteristics. The sintered NdFeB magnet according to the present invention is a long-awaited magnet which has all the aforementioned characteristics and can be used as a high-performance magnet of the highest quality.

In the present embodiment, the explanation is made for the case where Dy is used as $R_H$. However, if Tb (which is more expensive than Dy) is used in place of Dy, the value of $H_{cJ}$ can be further increased.

EXPLANATION OF NUMERALS

10 . . . Starting Alloy Ingot
11 . . . Main Phase
12 . . . Rare-Earth Rich Phase Lamella
13 . . . Fine Powder Grain
14 . . . Part of the Rare-Earth Rich Phase Lamella

The invention claimed is:

1. A method for manufacturing a sintered NdFeB magnet, comprising:

making a starting alloy ingot by a strip-cast method in which an amount of rare-earth in a metallic state is between 12.7% and 16.0% in atomic ratio and lamellas of rare-earth rich phases are formed at an average interval controlled to be substantially the same as a target average particle size;

making a powder containing particles in which fragments of the rare-earth rich phases are attached to main phase particles by grinding the starting alloy ingot so that an average particle size becomes the target average particle size;

sintering the powder to make a base material of the NdFeB magnet; and performing a grain boundary diffusion process of $R_H$, where $R_H$ is Dy and/or Tb, to the base material, wherein, in the powder, a rate of main phase particles to which the fragments of the rare earth rich phases are attached is equal to or higher than 80%.

2. The method for manufacturing a sintered NdFeB magnet according to claim 1, wherein any one of the following powders a) through e) is used in the grain boundary diffusion process:

a) a powder of an alloy containing $R_H$ and an iron group transition metal with an $R_H$ content of equal to or higher than 50 atomic percent;

b) a powder of a metal composed of only $R_H$;

c) a powder of a hydride of the alloy of the powder a);

d) a powder of a hydride of the metal of the powder b); and e) a mixed powder of $R_H$ fluoride powder and Al powder.

3. The method for manufacturing a sintered NdFeB magnet according to claim 2, wherein the powder containing $R_H$ is applied only to magnetic pole faces of the base material in the grain boundary diffusion process.

* * * * *